United States Patent [19]

Wilkinson

[11] Patent Number: 5,009,057

[45] Date of Patent: Apr. 23, 1991

[54] METHOD AND APPARATUS FOR SHRINK WRAPPING

[76] Inventor: Frank G. Wilkinson, 2276 Larson La., Dallas, Tex. 75229

[21] Appl. No.: 116,001

[22] Filed: Nov. 2, 1987

[51] Int. Cl.[5] ..... B65B 53/06

[52] U.S. Cl. ..... 53/439; 53/442; 53/557

[58] Field of Search ..... 53/439, 442, 530, 557

[56] References Cited

U.S. PATENT DOCUMENTS

| | | | |
|---|---|---|---|
| 2,525,651 | 10/1950 | Clunan | 53/443 |
| 3,113,874 | 12/1963 | Baush | 53/442 |
| 3,120,728 | 2/1964 | Snow | 53/442 |
| 3,340,670 | 9/1967 | Anderson | 53/442 |
| 4,592,193 | 6/1986 | Gustavsson | 53/530 |

*Primary Examiner*—John Sipos
*Attorney, Agent, or Firm*—Timmons & Kelly

[57] ABSTRACT

A shrink package system is disclosed which includes a conveyer for conveying an article covered by shrink film, a hot air chamber for blowing hot air on the shrink film while the article and shrink film are on the conveyer, a plurality of rollers and a support frame for supporting the plurality of rollers above the conveyer. The shrink film covered article travels between the conveyer and the rollers, displacing the rollers vertically. In one arrangement, the support frame includes a pair of side rails held in position by at least one threaded stud, the side rails forming slots with both vertical and horizontal components for receiving the rollers shafts.

12 Claims, 3 Drawing Sheets

METHOD AND APPARATUS FOR SHRINK WRAPPING

TECHNICAL FIELD

The present invention relates generally to methods and apparatus for packaging articles in shrink film, and in one of its aspects to packaging thin articles which are flimsy or easily deformed, bent or folded.

In shrink wrapping articles, it is common to entirely cover each article top and bottom with a shrink film such as polyvinyl chloride or polypropylene soft shrink material, and convey the shrink film covered article on a mesh or solid belt conveyer, or sometimes a roller conveyer, through a shrink tunnel which forms a hot air chamber. Typically, the air is heated to between 275° F. and 350° F. and blown onto the shrink film covered article while it is conveyed through the shrink tunnel. The hot air shrinks the shrink film onto the article. If the article happens to be flat and flimsy or easily warped or curled or bent, then the pressure exerted on the article by the shrinking shrink wrap is frequently enough to cause distortion or bending of the article. Sometimes the turbulent air in the hot air chamber causes light articles to float or otherwise move around in the chamber.

BACKGROUND ART

The inventor of the present invention is aware of two approaches to solving the problem of shrink wrapping thin or light articles. One approach is to use both bottom and top mesh or solid belt conveyers which are synchronized to travel in the same direction through the tunnel at the same speed. The top conveyer is spaced over the bottom conveyer at a distance which allows the particular article to fit between the two conveyers. The use of two synchronized conveyers is fairly expensive and requires resetting the distance between the two conveyers depending upon the article to be shrink wrapped. Such a system cannot be readily retrofit into existing shrink package systems which were not built with that feature.

The other approach to solving the problem of shrink wrapping thin or light articles is to develop a low energy shrink film which can be used at lower temperatures and with less air circulation.

DISCLOSURE OF INVENTION

In accordance with the present invention, a shrink package system for shrink wrapping an article with shrink film includes the combination of a conveyer for conveying the article covered by the shrink film, a hot air chamber for blowing hot air onto the shrink film while the article and shrink film are on the conveyer, a plurality of rollers, and a support frame for supporting the plurality of rollers above the conveyer. The conveyer can be a typical mesh or solid belt or roller conveyer. Typically such roller conveyers use silicon rubber roller cylinders. In a preferred form, each roller includes a shaft and a cylinder rotatably mounted on the shaft. In a preferred form, the support frame includes a pair of side rails spaced apart from each other and held in place by a number of threaded studs passing through both. The side rails support the plurality of rollers by each forming a plurality of slots. The slots receive the opposite ends of the shaft so that the shaft can slide within the slots. The slots in a preferred form have both vertical and horizontal components which allow the roller cylinders to actually rest on the conveyer until an article covered in shrink film makes contact with that roller and displaces the roller vertically and horizontally as the article is conveyed past it. The horizontal component of the slot allows the roller to yield somewhat in the direction that the conveyer and article are moving, making it easier for the article to lift the roller.

In one embodiment, an apparatus according to the present invention includes a plurality of spaced apart rollers and a support frame for supporting the plurality of rollers which can be installed into a preexisting shrink package system. Once again, a preferred form of the support frame includes a pair of spaced apart side rails forming slots for slidably receiving opposite ends of the roller shafts, but the support frame also includes brackets or braces or legs for supporting the frame within the shrink tunnel. Typically a shrink package system will have side ledges on either side of the conveyer, the side ledges having both a horizontal portion and an upwardly extending lip on the side opposite the conveyer to prevent articles from sliding completely off the conveyer. In such a shrink package system, legs positioned on the side rails down to the corresponding side ledges or into the corners formed by the upwardly ledges and the upperly extending lips are sufficient to maintain the support frame in a proper operating position.

A method for shrink wrapping a thin, flat article according to the present invention, includes the steps of first covering the work piece with shrink film, then conveying the shrink film covered article and holding the shrink film covered article down by exerting pressure on it by at least one roller while flowing hot air on the shrink film covered article.

These and other objects, advantages and features of this invention will be apparent from the following description taken with reference to the accompanying drawing, wherein is shown the preferred embodiments of the invention.

BEST MODE FOR CARRYING OUT THE INVENTION

Figure 1:
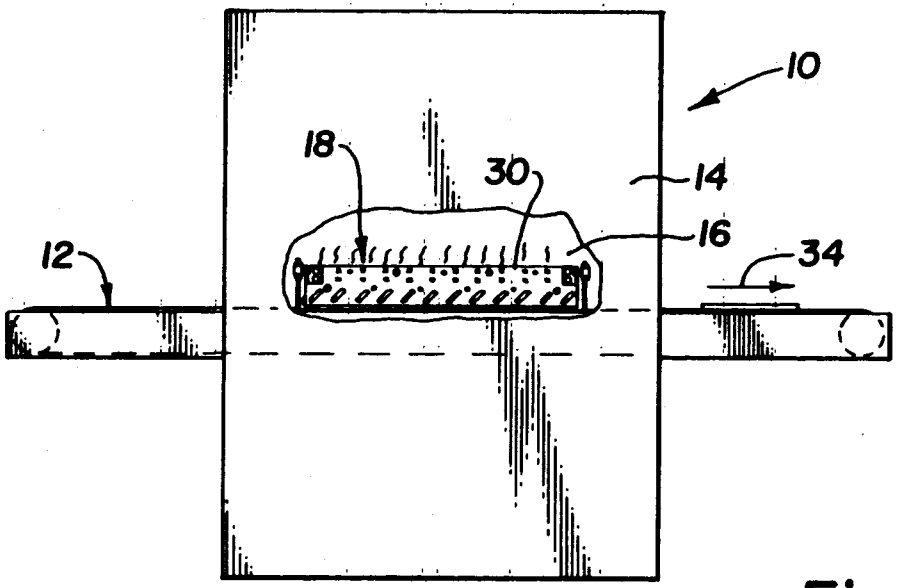
FIG. 1 is a right side elevational view of a shrink package system according to the present invention along with a shrink wrapped article.

Referring now to the drawing and in particular FIG. 1, a shrink package system according to the present invention is referred to generally by reference numeral 10. Shrink package system 10 includes conveyer means 12 conveying an article through shrink tunnel 14 forms means 16 for blowing hot air on the article and shrink film and an apparatus 18 according to the present invention for preventing articles from becoming deformed or lifted from conveyer means 12 during the shrink wrapping process.

Figure 2:
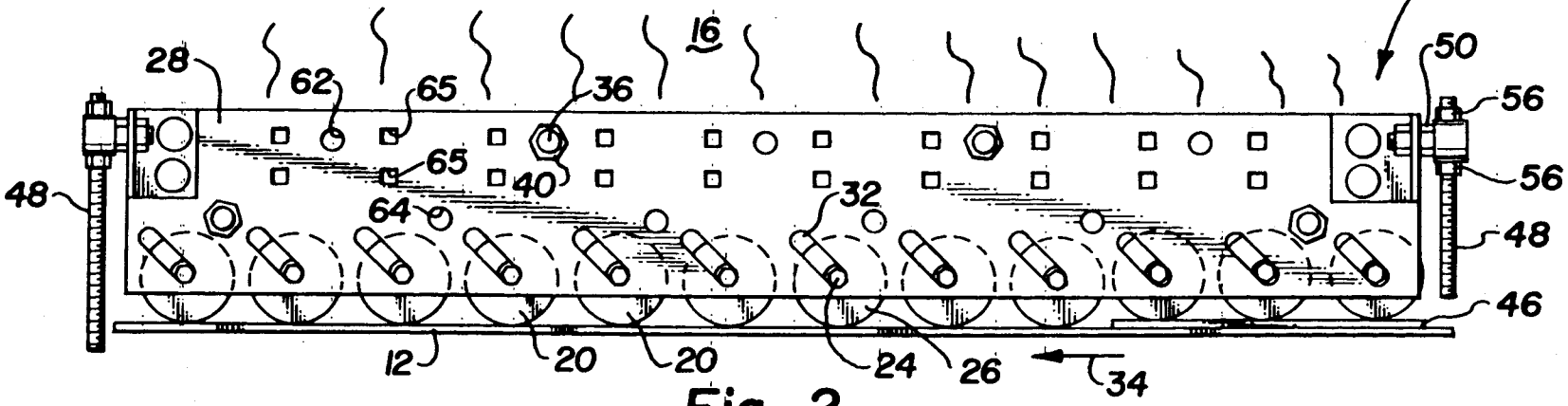
FIG. 2 is a left side elevational view of an apparatus according to the present invention positioned within a hot air chamber above a conveyer of a shrink package system and an article covered with shrink film to be shrink wrapped.
Figure 3:
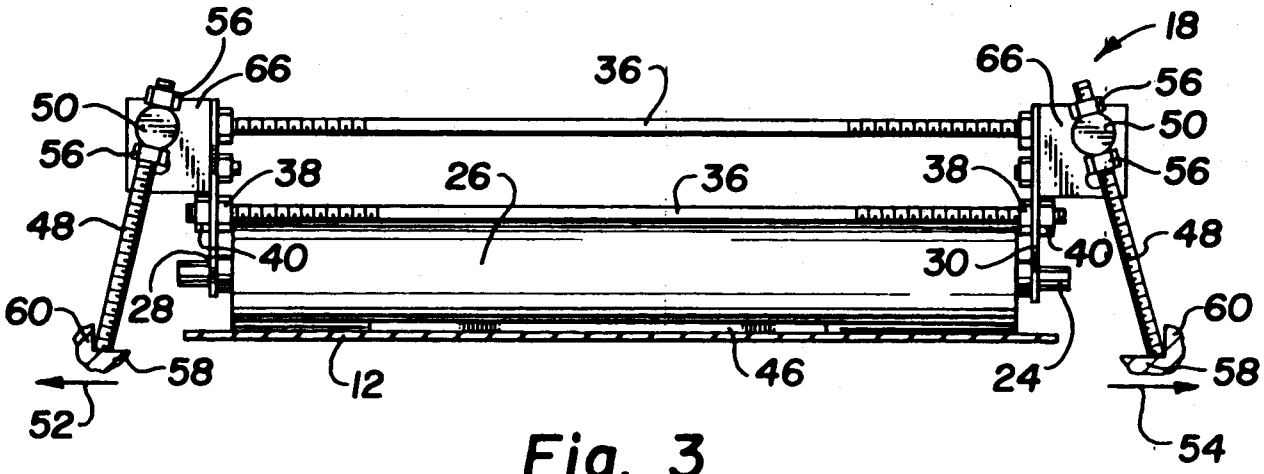
FIG. 3 is a front elevational view of the apparatus of FIG. 2 also showing side ledges and upwardly extending lips of the shrink package system.
Figure 5:
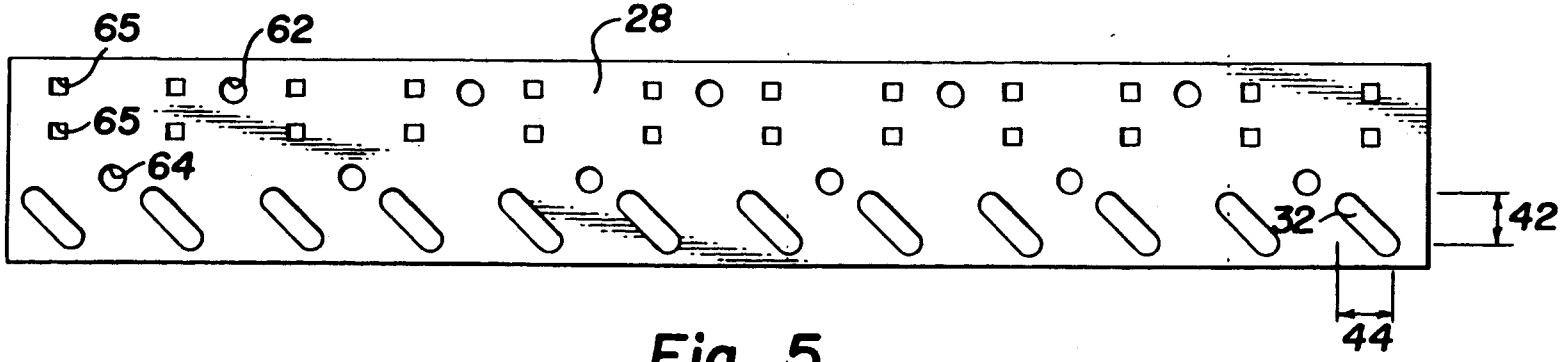
FIG. 5 is a an elevational view of a side rail of the apparatus of FIG. 2.
Figure 4:
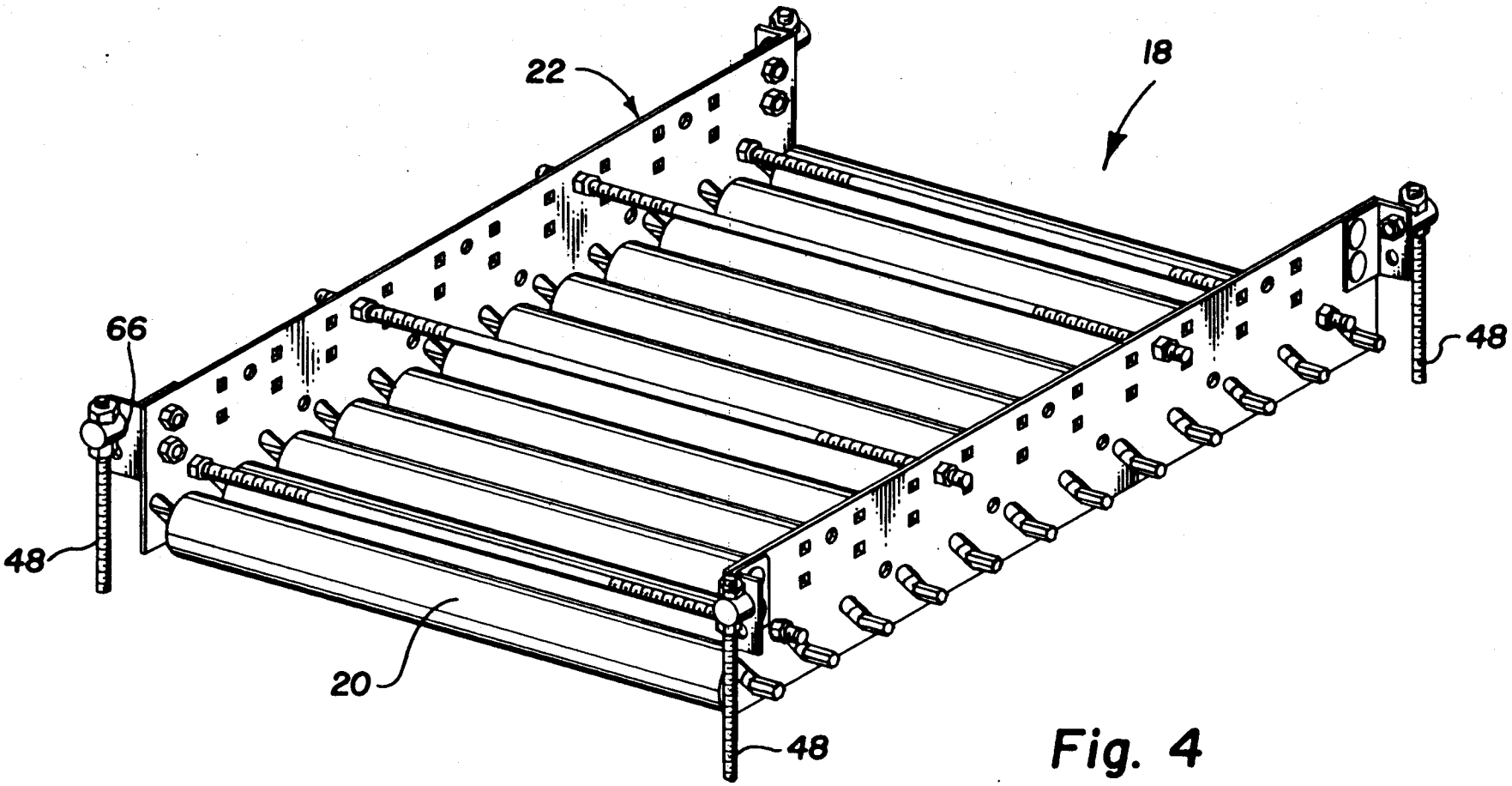
FIG. 4 is a left rear perspective view of the apparatus of FIG. 2.

Referring also to FIG. 2, FIG. 3 and FIG. 4, apparatus 18 includes a plurality of spaced apart rollers 20 and means 22 for supporting plurality of rollers 20 above conveyer means 12. Although means 22 for supporting plurality of rollers 20 maintains the rollers in a spaced apart relationship to each other physically located above conveyer means 12, rollers 20 are allowed to rest on conveyer means 12 in the embodiment illustrated in order to accommodate extremely flat articles to be shrink wrapped. Each of the plurality of rollers 20 includes a central horizontal shaft 24 and a cylinder 26 rotatably mounted on the shaft. In a preferred form each cylinder 26 is covered with a high temperature resistant non-stick coating such as silicon rubber or Teflon. Support means 22 includes a pair of side rails 28 and 30 spaced apart and forming slots 32 for receiving opposite ends of shafts 24. In a preferred form, slots 32 of left side rail 28 are directly opposite and identical in shape to slots 32 of right side rail 30 so that each of the plurality of rollers 20 is held perpendicular to the direction of motion 34 of conveyer means 12. Support means 22 also includes at least one threaded stud 36 passing through both side rails 28 and 30 for securing the side rails in the spaced apart relationship. In the embodiment shown, each threaded stud is secured to the side rails by inner nuts 38 and outer nuts 40. Referring also to FIG. 5, each slot 32 has a vertical component 42 and a horizontal component 44. Vertical component 42 allows the vertical displacement of one of the plurality of rollers 20 by an article 36 as the article is conveyed passed the roller. Horizontal component 44 of slot 32 allows a roller to be pushed slightly backwards in direction 34 of motion of conveyer means 12 and article 46, making it easier for article 46 to lift the roller.

Support means 22 also includes threaded legs 48 mounted to pivot about axes 50 in a direction 52 or 54 which is transverse to direction 34 of motion of conveyer means 12. Legs 48 can thus be pivoted outwardly from side rails 28 and 30 and adjusted in length through adjusting nuts 56 to properly brace against side ledges 58 and upwardly extending lips 60 of shrink package system 10. In a preferred form, threaded legs 48 are of the same diameter and thread pitch as threaded studs 36 so that all may be cut from the same stock. By simply cutting threaded studs 36 to the proper length, apparatus 18 can be easily made to work with any width conveyer or article.

A preferred form of side rail 28 or 30 forms regularly spaced upper holes 62 and regularly spaced lower holes 64 positioned just above slots 32 for receiving threaded studs 36. Side rails 28 and 30 also form regularly spaced pairs of aperatures 65 for receiving means 66 for mounting threaded legs 48. Rails 28 and 30 can thus be cut to any length without special manufacture, both rails can be cut from the same stock, simply reversing the direction which a particular rail faces to make it either right side rail 30 or left side rail 28.

A method according to the present invention for shrink wrapping thin flat article 46 includes the steps of covering the article with shrink film in the normal way which is well known in the art, conveying the shrink film covered article on conveyer means 12, holding the shrink film covered article down by exerting pressure from at least one of the plurality of rollers 20, and blowing hot air on the shrink film covered article in a hot air chamber or other means 16 for blowing hot air while the article is held down by the at least one roller.

It is now readily apparent that having plurality of rollers 20 spaced apart from each other allows the hot air to be blown in between them and around shrink film covered article 46. In the particular embodiment shown, roller cylinders 26 actually touch the surface of conveyer means 12 which imparts to each roller cylinder 26 rotational motion around its respective shaft 24, further facilitating the movement of shrink film covered article 46 underneath each of the plurality of rollers 20. It is preferable that the rollers each be allowed to go down low enough to be in actual contact with the particular article if not allowed to actually touch conveyer means 12, but it is perfectly possible to simply have the rollers slightly above the article which would be sufficient to prevent the article from curling or deforming more than a limited amount.

From the foregoing, it will be seen that this invention is one well adapted to attain all the ends and objects hereinabove set forth, together with other advantages which are obvious and which are inherent to the apparatus.

It will be understood that certain features and certain subcombinations are of utility and may be employed without reference to other features and some subcombinations. This is contemplated by and is within the scope of the claims.

As many possible embodiments may be made of the invention without departing from the scope thereof, it is to be understood that all matter herein set forth or shown in the figures of the accompanying drawing is to be interpreted as illustrative and not in a limiting sense.

I claim:

1. A shrink package system for shrink wrapping an article with shrink film, comprising in combination:

conveyer means for conveying the article covered by the shrink film;

means for blowing hot air on the shrink film while the article and shrink film are on the conveyer means;

a plurality of rollers; and means for supporting the plurality of rollers above the conveyer means wherein the article travels beneath the plurality of rollers as it is conveyed and wherein the covered article is in contact with at least one of the rollers during a substantial portion of the time in which it is subjected to the means for blowing hot air.

2. A shrink package system according to claim 1 wherein the means for supporting the plurality of rollers allows each roller to yield vertically whereby the article displaces a roller vertically as the article is conveyed past the roller.

3. A shrink package system according to claim 1 wherein each roller comprises a shaft and a cylinder rotatably mounted on the shaft and the means for supporting the plurality of rollers comprises a pair of side rails spaced apart and forming slots for slidably receiving opposite ends of the shafts, the slots having vertical components whereby the article displaces a roller vertically as the article is conveyed past the roller.

4. A shrink package system according to claim 3 wherein the means for supporting the plurality of rollers further includes at least one threaded stud passing through both side rails for securing the side rails in the spaced apart relationship.

5. A shrink package system according to claim 4 wherein each of the rollers includes a high temperature resistant non-stick covering.

6. An apparatus for installation into and use with a preexisting shrink package system having a shrink tunnel and conveyor means for conveying an article to be wrapped in shrink film through the shrink tunnel, the apparatus comprising in combination:

a plurality of rollers; and means for supporting the plurality of rollers above the conveyor means wherein the article travels beneath the plurality of rollers as it is conveyed through the shrink tunnel and is in contact with at least one of the rollers through a substantial portion of the shrink tunnel.

7. An apparatus according to claim 6 wherein the means for supporting the plurality of rollers allows each roller to yield vertically whereby the article displaces a roller vertically as the article is conveyed past the roller.

8. An apparatus according to claim 6 wherein each roller comprises a shaft and a cylinder rotatably mounted on the shaft and the means for supporting the plurality of rollers comprises a pair of side rails spaced apart and forming slots for slidably receiving opposite ends of the shafts, the slots having vertical components whereby the article displaces a roller vertically as the article is conveyed past the roller.

9. An apparatus according to claim 8 wherein the means for supporting the plurality of rollers further includes at least one threaded stud passing through both side rails for securing the side rails in the spaced apart relationship.

10. An apparatus according to claim 9 wherein each of the rollers includes a high temperature resistant non-stick covering.

11. A method for shrink wrapping a thin flat article, comprising in combination the steps of:

covering the article with shrink film;

conveying the shrink film covered article;

holding down the shrink film covered article by exerting pressure from at least one roller at a time from a plurality of spaced apart rollers; and blowing hot air on the shrink film covered article while it is held down by the at least one roller.

12. A method according to claim 11 wherein the step of holding down the shrink film covered article by exerting pressure from at least one roller comprises holding down the shrink film covered article by exerting downward pressure from a plurality of spaced apart rollers.

* * * * *